US012343613B2

(12) United States Patent
Simmonds

(10) Patent No.: US 12,343,613 B2
(45) Date of Patent: Jul. 1, 2025

(54) SIMULATION TECHNOLOGY FOR USE WITH A STATIONARY BICYCLE TRAINING SYSTEM

(71) Applicant: Jetblack Investments Pty Ltd, South Windsor (AU)

(72) Inventor: Tony Simmonds, Queenscliff (AU)

(73) Assignee: Jetblack Investments Pty Ltd, South Windsor (AU)

( * ) Notice: Subject to any disclaimer, the term of this patent is extended or adjusted under 35 U.S.C. 154(b) by 268 days.

(21) Appl. No.: 18/328,496

(22) Filed: Jun. 2, 2023

(65) Prior Publication Data

US 2024/0399233 A1 Dec. 5, 2024

(30) Foreign Application Priority Data

May 17, 2022 (AU) ..... 2022901312

(51) Int. Cl.
*A63B 71/06* (2006.01)
*A63B 69/16* (2006.01)

(52) U.S. Cl.
CPC ..... *A63B 71/0622* (2013.01); *A63B 69/16* (2013.01); *A63B 2069/163* (2013.01); *A63B 2069/165* (2013.01); *A63B 2071/0638* (2013.01); *A63B 2214/00* (2020.08); *A63B 2220/836* (2013.01); *A63B 2230/045* (2013.01); *A63B 2230/625* (2013.01)

(58) Field of Classification Search
CPC ..... A63B 22/0605; A63B 2022/0641; A63B 24/0062; A63B 2024/009; A63B 2024/0093; A63B 2024/0096; A63B 69/16; A63B 2069/163; A63B 2069/165; A63B 71/0622; A63B 2071/0638; A63B 2071/0644; A63B 2071/0647; A63B 2214/00; A63B 2220/76; A63B 2220/836; A63B 2225/20; A63B 2225/50; A63B 2230/045; A63B 2230/62; A63B 2230/625
See application file for complete search history.

(56) References Cited

U.S. PATENT DOCUMENTS 10,549,153 B2 * 2/2020 Fung ..... A63F 13/212
11,465,014 B2 * 10/2022 Fung ..... G06F 3/011
12,239,881 B1 * 3/2025 Schaefer ..... A63B 24/0062
(Continued)

FOREIGN PATENT DOCUMENTS

CN 105664469 A * 6/2016 ..... A63B 24/0087
CN 107469325 A * 12/2017
(Continued)

*Primary Examiner* — Gary D Urbiel Goldner
(74) *Attorney, Agent, or Firm* — TraskBritt

(57) ABSTRACT

The present invention relates, in various embodiments, to improved simulation technology for use with a stationary training system. In some embodiments, this includes use of sensors, for example, wearable sensors, to control simulation parameters (such as display and/or performance parameters). For example, in some embodiments, a body worn sensor, such as an accelerometer and/or gyroscope, is used thereby to infer body position attributes of a user and, in response, configure one or more simulation parameters. These may include, for example, display parameters (for example, whether a simulated avatar is seated or standing) and/or performance parameters (for example, simulated wind resistance).

17 Claims, 2 Drawing Sheets

(56) References Cited

U.S. PATENT DOCUMENTS

| | | | | |
|---|---|---|---|---|
| 2007/0093360 | A1* | 4/2007 | Neff | A63B 22/0605 482/8 |
| 2007/0117680 | A1* | 5/2007 | Neff | A63B 24/0084 482/8 |
| 2007/0219059 | A1* | 9/2007 | Schwartz | A61B 5/329 482/8 |
| 2007/0281828 | A1* | 12/2007 | Rice | A63B 22/0605 482/4 |
| 2011/0118086 | A1* | 5/2011 | Radow | A63B 21/00196 482/5 |
| 2018/0290017 | A1* | 10/2018 | Fung | G06F 3/012 |
| 2019/0070461 | A1* | 3/2019 | Werner | A63B 69/16 |
| 2019/0143173 | A1* | 5/2019 | Fung | A63B 24/0006 710/1 |
| 2019/0209891 | A1* | 7/2019 | Fung | G06F 3/0338 |
| 2020/0179752 | A1* | 6/2020 | Fung | A63B 22/02 |
| 2020/0261767 | A1* | 8/2020 | Fung | G06F 1/1694 |
| 2020/0276473 | A1* | 9/2020 | Fung | A63F 13/65 |
| 2021/0001171 | A1* | 1/2021 | Fung | A63B 22/0292 |
| 2022/0096897 | A1* | 3/2022 | Fung | A63F 13/22 |
| 2022/0152452 | A1* | 5/2022 | Fung | A63B 23/04 710/1 |
| 2023/0173335 | A1* | 6/2023 | Simmonds | A63B 71/0622 482/4 |

FOREIGN PATENT DOCUMENTS

| | | | | | |
|---|---|---|---|---|---|
| CN | 107952215 | A | * | 4/2018 | |
| WO | 2021/022297 | A1 | | 2/2021 | |
| WO | WO-2021197444 | A1 | * | 10/2021 | A63B 22/0605 |

* cited by examiner

SIMULATION TECHNOLOGY FOR USE WITH A STATIONARY BICYCLE TRAINING SYSTEM

CROSS-REFERENCE TO RELATED APPLICATION

This application claims the benefit of the filing date of Australian Patent Application Serial No. AU 2022901312, filed May 17, 2022, for "IMPROVED SIMULATION TECHNOLOGY FOR USE WITH A STATIONARY BICYCLE TRAINING SYSTEM, INCLUDING USE OF WEARABLE SENSORS TO CONTROL DISPLAY AND/OR PERFORMANCE PARAMETERS AND/OR CONTROL OF SIMULATION PARAMETERS RESPONSIVE TO RIDER BODY POSITION," the disclosure of which is hereby incorporated herein in its entirety by this reference.

TECHNICAL FIELD

The present disclosure relates, in various embodiments, to improved simulation technology for use with a stationary training system. In some embodiments, this includes use of wearable sensors to control display and/or performance parameters. For example, in some embodiments, a sensor, which may optionally be a motion sensor (for example, a wearable sensor), such as an accelerometer and/or gyroscope, is used thereby to infer body position attributes of a user, and in response configure one or more simulation parameters. These may include, for example, display parameters (for example, whether a simulated avatar is seated or standing) and/or performance parameters (for example, simulated wind resistance).

BACKGROUND

Any discussion of the background art throughout the specification should in no way be considered as an admission that such art is widely known or forms part of common general knowledge in the field.

Various common configurations of a bicycle trainer systems include a device that supports the rear of a bicycle. For example, this may include a trainer unit that connects to a rear axle region of the bicycle frame in place of a rear wheel, or a trainer unit into which a conventionally affixed rear wheel of the bicycle is mounted. In either case, a basic premise of the system is that the bicycle is supported in a substantially stable position in which a rider is able to pedal the bicycle in a stationary position with resistance being provided via the trainer unit.

In recent years, various simulation systems have been developed to operate in conjunction with bicycle trainer systems, thereby to provide a visual simulation of bicycle riding, and hence improve user experience in using a bicycle trainer system. However, increasing the realism of bicycle trainer system use via a visual simulation has had a corresponding effect of highlighting aspects of trainer use that deviate from realism.

Technology disclosed herein seeks to ameliorate problems of the prior art.

BRIEF SUMMARY

Example embodiments are described below in the section entitled "claims," and in the section entitled "detailed description."

Reference throughout this specification to "one embodiment." "some embodiments" or "an embodiment" means that a particular feature, structure or characteristic described in connection with the embodiment is included in at least one embodiment of the present disclosure. Thus, appearances of the phrases "in one embodiment." "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms "comprising." "comprised of" or "which comprises" is an open term that means including at least the elements/features that follow, but not excluding others. Thus, the term "comprising," when used in the claims, should not be interpreted as being limitative to the means or elements or steps listed thereafter. For example, the scope of the expression a device comprising A and B should not be limited to devices consisting only of elements A and B. Any one of the terms "including" or "which includes" or "that includes" as used herein is also an open term that also means "including at least" the elements/features that follow the term, but not excluding others. Thus, "including" is synonymous with and means "comprising."

As used herein, the term "exemplary" is used in the sense of providing examples, as opposed to indicating quality. That is, an "exemplary embodiment" is an embodiment provided as an example, as opposed to necessarily being an embodiment of exemplary quality.

BRIEF DESCRIPTION OF THE DRAWINGS

Embodiments of the disclosure will now be described, by way of example only, with reference to the accompanying drawings in which.

DETAILED DESCRIPTION

Figure 1:
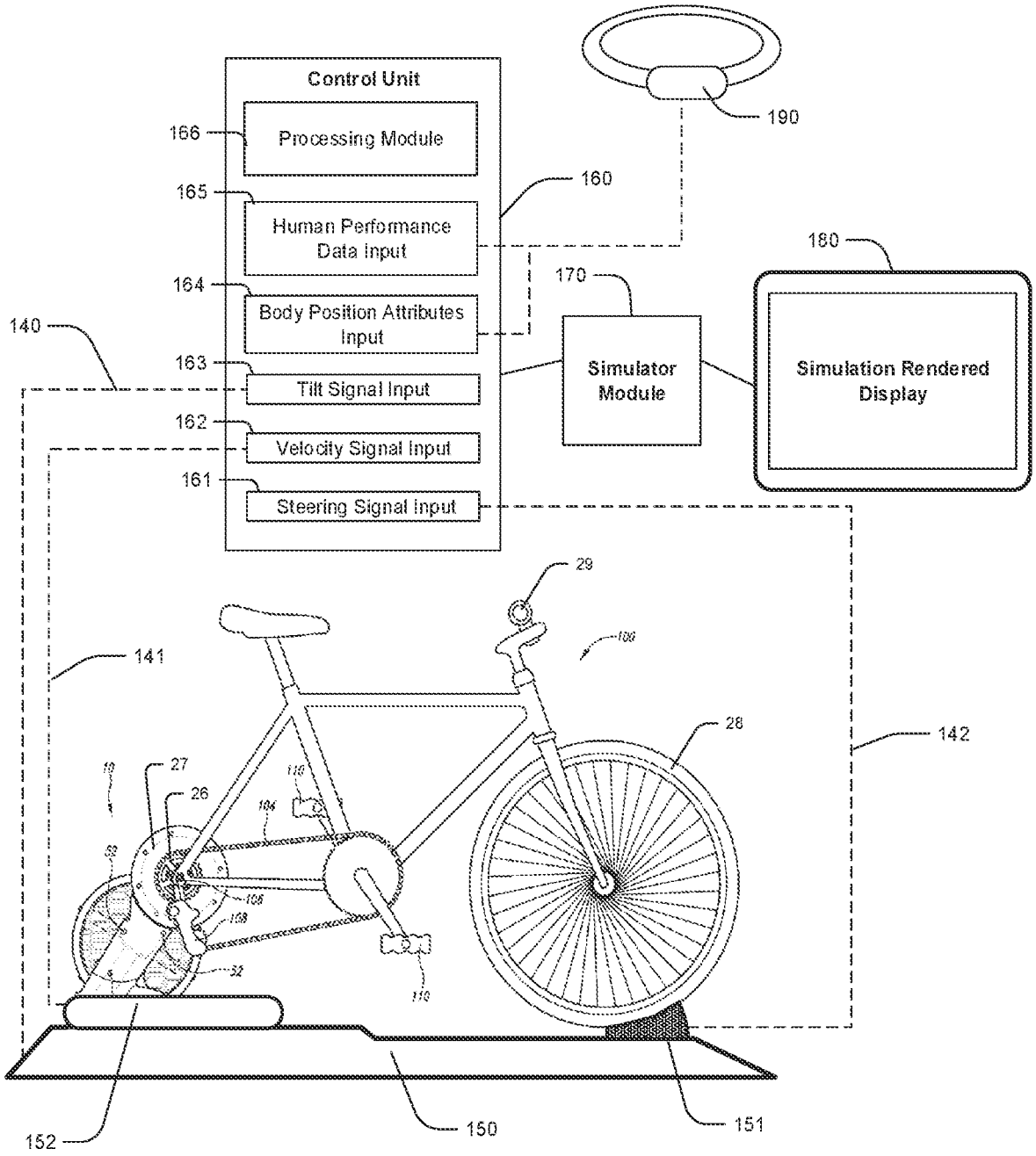
FIG. 1 illustrates an arrangement according to one embodiment.

The present disclosure relates, in various embodiments, to improved simulation technology for use with a stationary training system. In some embodiments, this includes use of sensors, for example, wearable sensors, to control simulation parameters (such as display and/or performance parameters). For example, in some embodiments, a body worn sensor, such as an accelerometer and/or gyroscope, is used thereby to infer body position attributes of a user, and in response configure one or more simulation parameters. These may include, for example, display parameters (for example, whether a simulated avatar is seated or standing) and/or performance parameters (for example, simulated wind resistance).

Various embodiments described below are applicable in the context of several categories of bicycle trainer systems. These include:

Trainers that are configured to receive a complete bicycle, and engage with a rear wheel of that bicycle thereby to offer resistance. These are often referred to as "wheel-on" trainers.

Trainers that are configured to receive a partially deconstructed bicycle, deconstructed in the sense that the rear wheel is removed, and engage with a drivetrain that bicycle thereby to offer resistance. These are often referred to as "wheel-off" trainers. In these examples, the existing bicycle drivetrain typically attaches to a cassette that is mounted to the trainer assembly.

Integrated trainers. These are trainer assemblies that have an integrated bicycle drivetrain, saddle and cockpit, often referred to as "stationary bicycles." These differ from the previous examples in the sense that, in the previous examples, a conventional bicycle is mounted to a trainer, and in this example, the trainer does not require a separate bicycle to be mounted.

It will be appreciated that various aspects of technology described herein are, while described in relation to only one category of trainer, are applicable to multiple categories of trainer. For example, technology related to control of simulation parameters based on body position attributes, are applicable to all categories of trainer.

Various embodiments described below relate to "simulation systems," which operate in conjunction with bicycle trainer systems. The term "simulation system" should be read broadly enough to include:

Hardware integrated with a bicycle trainer system.

A combination of hardware integrated with a bicycle trainer system, with one or more connected devices (such as smartphones, televisions, media rendering devices such as APPLE TV®, and so on).

Processing devices that are connected to bicycle trainer systems (such as smartphones, televisions, media rendering devices such as APPLE TV®, and so on).

In overview, a bicycle simulation system performs functionalities in the context of a simulation whereby input is provided by a bicycle trainer system, optionally in combination with one or more other sensor-enabled devices, and output is delivered via a display screen thereby to display simulated bicycle riding in a virtual environment. In some embodiments, there is one-way flow of instructions (i.e., the trainer system and other connected devices push data to processing components, which leads to rendering simulation data on a screen), and in other embodiments, there is two-way flow of instructions (e.g., data defined in simulation software, for example, a value representing incline of a virtual hill or a value representing virtual wind resistance) is used to control performance parameters in the form of operational parameters of a trainer system (for instance, increasing/decreasing pedaling resistance to mimic conditions in a virtual environment in which the simulation takes place).

While in most cases, a bicycle simulation system provides a visual output representative of simulated bicycling activity in a virtual environment, that is not necessary. In some embodiments, the physical activity of a user interacting with a bicycle training system is represented via a virtual avatar in a virtual environment that is not bicycle related, for example, as an alternate form of vehicle, animal, or the like.

In overview, embodiments of the technology disclosed herein relate to improving the realism of trainer-driven simulations, primarily by determining body position of a user. In the examples below, particular focus is given to embodiments in which sensors are used to determine (i.e., predict via digital means) whether a user is in a seated or standing position. This may include the use of motion sensors, for example, accelerometers and/or gyroscopes. For instance, some examples below refer to the use of a torso-mounted motion sensor, which is optionally provided via a biometric sensor device, such as a heart rate monitor. Those skilled in the art will recognize that various torso-mounted heart rate sensors, such as a device currently marketed under the brand name "GARMIN® HRM-PRO," include both heart rate sensors and motion sensors (such as accelerometers). In some embodiments, such devices are used to deliver motion sensor data to a simulator system (for example, with the data being transmitted via a control unit associated with a bicycle trainer system). Head mounted sensors (for example, smart glasses) may also be used.

Those skilled in the art will appreciate how data from a motion sensor may be processed thereby to determine body position attributes. For example, AI classifier technology may be used. That may, in some embodiments, include collecting training data from a variety of users interacting with bicycle trainer systems, and labelling that data based on body position. In one embodiment, blocks of time series motion sensor data are labelled as "standing, pedaling," "standing, coasting," as "seated, coasting," "standing, coasting," thereby to train an AI classifier to determine body position from real-time motion sensor data (separate classifiers may be trained for differently-positioned motion sensors, such as torso-mounted, head-mounted, wrist-mounted, trainer-mounted and/or bicycle mounted). Other labels may also be used additionally and/or alternately, for example, labels representative of a degree of tuck (for example, "upright," "medium tuck" and "deep tuck").

Example embodiments include:

A method of operating a bicycle simulation system, which includes receiving data from a biometric sensor device that provides heart performance information (for example, a torso-mounted heart rate sensor), wherein the received data additionally includes motion and/or position data. The method further includes controlling operation of the bicycle simulation system based on the motion and/or position data. For example, this may include controlling performance parameters (such a virtual wind resistance, which varies dependent on rider position, for instance, seated or standing) and display parameters (for example, whether a virtual avatar is shown in a seated or standing position).

A method of operating a bicycle simulation system including: (i) determining from sensor input data whether a user is interacting with a bicycle training system in a seated position or a standing position; and (ii) controlling parameters of the bicycle simulation system dependent upon whether the user is interacting with a bicycle training system in a seated position or a standing position. For example, this may include controlling performance parameters (such a virtual wind resistance, which varies dependent on rider position, for instance, seated or standing) and display parameters (for example, whether a virtual avatar is shown in a seated or standing position). The controlling of performance parameters may include software parameters (for example, mapping physical trainer operation parameters to virtual parameters such as virtual velocity) and/or hardware parameters (for example, providing an instruction to adjust a resistance setting on a trainer system). In this category of embodiments, the sensor data used to determine whether a user is in a seated position or standing position may include a sensor mounted to the user, or another sensor. For instance, an accelerometer mounted to a bicycle frame, a sensor in a rocker plate may be used to identify data artefacts representative of standing pedaling or seated pedaling. In some embodiments, a combination may be used.

Bicycle trainer systems that enable performance of the above methods.

A bicycle trainer system including an input configured to interact with a device that collects both heart performance information and motion data, the bicycle trainer system including an output configured to provide data derived from the heart performance information and motion data to a simulation system.

Wearable devices (for example, heart rate monitors, smart watches, smartphones in mounts, smart glasses, and/or headwear) that are configured to provide motion senor data (which may include data derived from processing of motion sensor data) thereby to enable controlling of a simulation system responsive to body position attributes.

Simulation systems configured to operate with the above methods, trainer systems, and/or wearable devices.

An example class of embodiment provides a method for controlling a simulation system. The simulation system includes:

(i) An input configured to receive data representative of user pedaling interaction with a bicycle training system (for example, data that is directly or indirectly representative of a rear wheel virtual velocity). For example, this may be a BLUETOOTH® or Wi-Fi connection to a bicycle training system. The data representative of user interaction preferably includes a virtual velocity signal, which is determined by components of the training system. This data may additionally and/or alternately include attributes such as wheel RPM and pedaling cadence.

(ii) One or more further inputs that provide data collected by further sensors. These may include any one or more of a range of inputs, including, by way of example: (a) steering sensors (for example, via a sensor-enabled rotating wheel block); (b) bicycle tilt sensors (for example, via a sensor-enabled rocker plate, accelerometers, or the like); (c) biometric sensors (for example, heart rate sensors). In some embodiments, the input of (i) and the one or more inputs of (ii) are combined into a single input, for example, where a bicycle trainer system includes a control unit that receives data from multiple sensors, and combines those into a single signal that is transmitted to the simulator system via a BLUETOOTH® connection or the like.

The inputs above may include sensor data, and/or processed sensor data. For example, in some embodiments, functionality of simulation system is provided by software executing on a device that provides a display screen, such as a smartphone, PC, APPLE TV®, or the like, and the input is a BLUETOOTH® connection to a control unit provided by a bicycle trainer system. The controller unit includes firmware/software configured to receive data feeds from a plurality of sensors (for example, speed, tilt, turn, heart rate, motion sensor, and so on), and process those to provide an input feed for the simulation system. That input feed is defined as variables that are recognized by the simulation system, thereby to enable the simulation system to render a visual simulation interface. The simulation interface preferably displays riding performance attributes (for example, velocity, power, heart rate, and the like) in addition to a virtual simulation environment, which may include an avatar representative of the user riding a virtual bicycle, optionally in combination with other avatars that may represent other real-world users having similar equipment networked at other locations (i.e., online competitions in a virtual environment).

The simulation system additionally includes a processing module configured to process data received via the input and the one or more further inputs thereby to define simulation parameters. The simulation parameters include:

(i) Performance parameters for simulated bicycle riding. For example, this includes determining a current simulated riding velocity. This riding velocity is preferably calculated from multiple variables, for example, a variable that is determined from pedaling input to the trainer system, a variable representative of virtual incline in the simulation, and a variable representative of virtual wind resistance (which may be affected by factors such as virtual "drafting" behind another virtual rider, and user body position as described further below).

(ii) Display parameters for a graphical interface, which is configured to cause rendering of visual simulation data for the simulated bicycle riding. These preferably include parameters that affect display of graphical artefacts in a virtual simulation environment, for example, as discussed further below, body position of a virtual avatar.

According to this class of embodiments, the method of containing the simulator system includes including:

(i) Identifying, in the data collected by further sensors, data derived from a body-worn motion sensor device. This may include sensor data (e.g., processed/raw data derived from an accelerometer and/or gyroscope), or a value that is calculated by a trainer control system based on processing of data received from the body-worn motion sensor device.

(ii) Processing the data derived from a body-worn motion sensor device thereby to define data representative of body position attributes. Where the data is processed/raw data derived from an accelerometer and/or gyroscope, this may include processing that data using an algorithm, which is configured to determine a body position via identification of data artefacts. Examples of how such algorithms may be configured are provided further below. In some cases, the processing of sensor data occurs at a control unit of the trainer system (which defines body position attribute variable data, and transmits that data to the simulator system), and the processing at the simulator system includes identifying relevant body position attribute variable data in data received from the trainer system control unit.

(iii) Operating the processing module to set one or more simulation parameters in response to the data representative of body position attributes.

In some embodiments, the step of operating the processing module to set one or more simulation parameters in response to the data representative of body position attributes includes: setting a wind resistance parameter responsive to the body position attributes. For example, in some cases the body position attributes are representative of either a "seated" state or a "standing" state, and a wind resistance parameter is set in response. For instance, setting a wind resistance parameter responsive to the body position attributes includes identifying whether the body position attributes are representative of a standing pedaling motion or a seated pedaling motion (and, in some embodiments, a standing coasting position or a seated coasting position). The body position data attributes may be representative of a transition between seated position and standing position, thereby to determine a current pedaling state of seated or standing. In such examples, there is a binary distinction between seated position and standing position (e.g., "1" representing seated and "2" representing standing). However, in some embodiments, where motion sensor data allows, the body position data attributed attributes include a torso position, for example an angle of inclination relative to the horizontal. This enables setting of a body position attribute that is representative of degree of "tuck" position, optionally defined as a numerical variable (e.g., "1" representing vertical, and "10" representing horizontal, or "1" representing upright, "2" representing moderate tuck, and "3" representing deep tuck), with these each being mapped to a wind resistance parameter setting. In a more complex implementation, both a seated/standing attribute and a torso angle attribute are used to set the wind resistance parameter (hence accounting to degree of "tuck" for both standing position and seated position).

In some embodiments, wind resistance is set as a numerical variable, with higher variable values representing greater wind resistance. This may lead to either or both of the following:

Adjustment of virtual motion, for example, velocity and/or acceleration. A higher variable value for wind resistance is configured to downwardly adjust a virtual velocity relative to a baseline determined based on pedaling input (e.g., a virtual velocity extrapolated in part from RPM determined in the of the trainer system), for example, as applied as virtual negative acceleration or as a scalar adjustment. An algorithm is configured to map a numerical value representative of body position to a numerical value representative of wind resistance. The setting of the wind resistance parameter may additionally/alternately be affected by factors other than body position, for example, virtual "drafting" and/or virtual environmental wind settings. From a user perspective, the user observes a degree of virtual deceleration, which varies in response to virtual wind resistance. This may be applied in the case of pedaling and/or coasting.

Adjustment of trainer resistance. A higher variable value for wind resistance is configured to cause a control instruction thereby to increase pedaling resistance in a trainer system. As such, a user needs to pedal harder to achieve a given virtual velocity. This may be implemented in a similar manner to which hill inclines are treated in existing systems.

In this manner, a simulation system according with the present disclosure is configured to process input data, for example, motion sensor data from a torso-worn heart rate sensor assembly, thereby to determine body position in terms of standing/seated position (and optionally torso angle/degree of acrodynamic tuck position), and on that basis control simulation performance parameters, for example, parameters that apply a virtual wind resistance. In addition to controlling such simulation performance parameters, the body position data may also include simulation display parameters. The term "display parameters" related broadly to parameters of a rendered graphical interface, which provides an avatar representative of riding in a virtual environment. Again, using the example of seated/standing body position (and/or tuck position), any one or more of the following may be applied:

Mapping each of a seated and standing body position to respective a set of animation assets (one showing an avatar riding seated, the other showing standing), and the set of assets being applied in the display parameters are selected accordingly.

Mapping each of a plurality of body tucking positions to a respective set of animation assets (each showing an avatar bent at the torso in a particular degree of tuck), and the set of assets being applied in the display parameters are selected accordingly.

Applying the preceding two in combination, such that there are different sets of animation assets for respective degrees of standing tuck and respective degrees seated standing tuck.

For a first-person camera view, adjusting the location of the FOV view (i.e., virtual camera position) based on body position attributes (standing/seated and/or degree of tuck), thereby to provide a realistic view relative to the virtual environment.

While the examples above are directed to body position attributes representative of standing/seated position (and/or degree of tuck), including for the purposes of applying a virtual wind resistance in a simulation, other body position attributes may also be used. Some examples are provided below.

In some examples sideways lean of the user is identified and used to control simulation parameters including performance and/or display parameters. For example, sideways lean can be used by a user to provide an input relevant to steering. This may be an isolated input—e.g., a user steers in the simulation by wearing a torso-mounted heart rate sensor with accelerometer. It may also be a component in a multi-input steering arrangement—for example, steering input is derived from a combination of a steering sensor as described in PCT Publication WO202122297, and body lean derived from a torso-mounted accelerometer—or in a more complex example, a combination of a steering sensor, body lean, and bicycle lean (for example, using a rocker plate or other arrangement as described in PCT Publication WO202122297). Display parameters are preferably also controlled in response, such that an animated avatar is shown performing a steering maneuver corresponding to the user inputs.

In some examples twisting of the torso is used to provide an intentional input to the simulation system. For instance, this may be optionally used in a first-person POV simulation to trigger a look to the side and/or behind, such that the user is able to look in sideways/rearwards directions. This has applicability in circumstances such as where there are multiple virtual riders, and the user wishes to compare their position in a virtual race or the like.

In some embodiments, motion sensor data is used to infer a rider pedaling "style," for example, whether that is smooth or aggressive (which may be determined by a degree of body movement during pedaling). This may be used to provide additional realistic personalization to an avatar via control of display parameters.

Various embodiments above use motion sensor data to infer body position. Those skilled in the art will understand a range of technical approaches whereby motion sensor data (for example, accelerometer and/or gyroscope data) is able to be processed thereby to identify body position attributes (including inferring such attributes from motion that represents movement between positions). Examples of data analysis approaches that may optionally be used are described below.

Torso movement during seated pedaling varies considerably from torso movement during standing pedaling. Algorithms may be configured to identify artefacts in accelerometer data that are representative of seated pedaling and standing pedaling, thereby to determine which is occurring at present.

Likewise, torso movement during seated coasting varies considerably from torso movement during standing coasting (particularly where a rocker plate is being used). Algorithms may be configured to identify artefacts in accelerometer data that are representative of seated coasting and standing coasting, thereby to determine which is occurring at present.

There are motion attributes observable in accelerometer data that represent a transition between a seated and standing position for a user on a bicycle trainer system. These may be identified, thereby to trigger a state shift between seated and standing (or vice-versa).

Angle of a motion sensor device (for example, relative to gravity), and changes therein, may be identified where sufficient motion sensor data is available. For example, this is possible where an IMU is present (as opposed to a single accelerometer).

It will be appreciated that a torso-mounted motion sensor may also be able to identify data attributers relevant to other aspects of trainer use, for example, providing a cadence sensor from analysis of body motion.

FIG. 1 illustrates an example implementation arrangement according to one embodiment. This example includes an extensive selection of components, not all of which are present in all embodiments.

FIG. 1 illustrates an example arrangement making use of a "wheel-off" trainer assembly 10. Trainer 10 includes an arm 52, which extends from a base member 152. Arm 52 supports a freewheel assembly 27, which is coupled to trainer internals, which are configured to provide resistance, monitor rotational velocity, and other functions. Trainer 10 may be operated by a user for stationary riding when coupled to a conventional bicycle 100 (shown in FIG. 1). To use the bike trainer 10, a user first removes the rear wheel of the bicycle 100, secures the rear dropouts 106 of the bicycle to the bike trainer 10, tightens the axle clamp adjustment, and aligns a chain 104 of the bicycle with one of the sprockets of the cassette 26. In operation, the cassette 26 works with a rear derailleur 108 of the bicycle 100 to provide multiple gear ratios for a user of the bike trainer 10. The cassette is mounted to a freewheel assembly 27 of the trainer. In this regard, trainer 10 operates substantially as any of a wide range of known wheel-off trainers. In a further embodiment, arm 52 and freewheel assembly 27 are replaced with a wheel-on trainer functional assembly.

Regardless of the style of trainer used, a component of trainer 10 provides an output, which may be wired or wireless (for example, Wi-Fi or BLUETOOTH®), which provides what is referred to herein as a "velocity signal," which represents a simulated velocity based on data observations. The velocity signal is representative of the rate at which bicycle 100 would be moving, if it were not attached to trainer 10 (which is wholly or primarily effected by pedaling of bicycle 100 using pedals 110). This is optionally calculated by measuring a velocity RPM of a component of trainer 10, and extrapolating that to a bicycle wheel size (or, in the case of a wheel-on trainer, based on the linear velocity of the bicycle wheel/tire periphery). The velocity signal is, in some embodiments, additionally representative of other effects of user interaction with the drivetrain of bicycle 100 (via pedaling using pedals 110), for instance, optionally including cadence. In some embodiments, the simulated velocity is derived from measurements of power.

The velocity signal is optionally calculated by measuring a velocity RPM of a component of trainer 10, and extrapolating that to a bicycle wheel size (or, in the case of a wheel-on trainer, based on the linear velocity of the bicycle wheel/tire periphery). The velocity signal is, in some embodiments, additionally representative of other effects of user interaction the drivetrain of bicycle 100 (via pedaling using pedals 110), for instance, optionally including cadence.

Velocity signal 140 is transmitted via a wired or wireless coupling to a velocity signal input 162 of a control unit 160. Control unit 160 then passes on the velocity signal, or a signal derived therefrom, to a simulator system 170. In some embodiments, control unit 160 is physically housed inside trainer 10. As described further below, control unit 160 is configured to receive data from a plurality of input sources beyond the velocity signal, in this example, including a steering input signal, tilt input signal, motion sensor input signal, and a human performance input signal (e.g., heart rate), and includes a processing module 160. Processing module 160 is configured to provide to simulator module 170 data derived from the various inputs in a predefined format, and is additionally responsive to signals from module 170 to set a resistance parameter for freewheel assembly 27 (for example, to apply the effect of an incline and/or wind resistance relevant to a virtual simulation environment).

Simulator system 170 includes a microprocessor, which is configured to execute computer code (software instructions), which are stored on a memory module of simulator system 170. These software instructions include software instructions configured to provide a bicycle simulator program, which delivers a rendering of a simulation interface on a display screen 180. This simulation preferably includes a representation of vehicular travel (typically bicycle travel), with a velocity of travel being controlled based on the velocity signal. For example, the simulation interface provides a rendered display of simulated bicycle riding at a simulated velocity corresponding to a measured theoretical velocity determined from the velocity signal. It should be appreciated that, although the input device for the simulator in the present embodiments is a bicycle or bicycle-like device, their simulator need not show simulated bicycling (for example, in one embodiment a user interacts with the bicycle inputs to control an airplane in the virtual environment).

In the illustrated embodiment, a front wheel 28 of bicycle 100 is mounted to a front wheel support unit 151. Front wheel support unit 151 includes a top part, which is configured to pivot about a vertical axis, thereby to enable turning of handlebars 29 is bicycle 100, and in doing so simulate steering. A specific example of a suitable wheel support unit is described further below. Front wheel support unit 151 includes a sensor, which is configured to measure pivoting, and hence provide a signal representative of bicycle steering activity, referred to as a steering input 142. This is transmitted via wired or wireless communication to a steering signal input 161 of control unit 160.

In further embodiments, steering signal 142 is derived by other means. These may include:

A sensor that is configured to directly measure rotation of a steerer tube relative to the frame (particularly relevant in the case of integrated trainers, where there is no front wheel).

An accelerometer mounted to the handlebars or a component that rotates with the handlebars (for example, forks, stem, hub, or the like). In some embodiments, this is provided via a smartphone that is mounted to the handlebars or stem.

As noted, steering signal 142 is transmitted via a wired or wireless coupling to a steering signal input 161 of control unit 160. Control unit 160 then passes on the steering signal, or a signal derived therefrom, to simulator system 170. Simulator system 170 is configured to, based on the steering signal, simulate bicycle steering. For instance, in a simple example, an angle of handlebar steering 29 on bicycle 100 is converted to a degree of simulated bicycle steering/turning in the simulated virtual environment.

In some embodiments, steering simulation via simulator system 170 is controlled via steering signal 142 in isolation. However, in other embodiments, as described below, steering simulation via simulator system 170 is controlled by way of a combination of monitoring steering and bicycle tilt. This combination provides a more realistic simulation, as in practice steering via handlebars is only part of the overall process of steering a bicycle, with tilt being of equal or greater importance.

Tilt is facilitated by way of a tilting plate, also referred to as a rocker plate. Combining tilt and steering into a trainer arrangement provides a much more natural feel to a user, and optionally as discussed herein can allow for an improved simulator system.

An example rocker plate 150 is illustrated. Various forms of rocker plate are commercially available (for example, currently sold by brands KOM Cycling and LifeLine). These rocker plates typically include an upper plate member, to which trainer 10, and optionally front wheel support unit 151, is enabled to be mounted. In some embodiments, either or both of trainer 10 and front wheel support unit 151 are integrally formed with the upper plate member. The upper plate member is coupled to a lower plate member, such that the upper plate member is able to tilt about a horizontal axis, which is parallel and aligned with the central plane of the bicycle, typically by between 10 and 20 degrees in each direction. This allows a bicycle, when mounted, to tilt from side-to-side. A bias mechanism is provided thereby to provide a bias force between the upper and lower plate mechanisms. In some embodiments, the bias mechanism is provided by one or more pairs of resident balls (for example, inflated rubber balls, tennis-style balls, or the like), which are sandwiched between the upper and lower plates, and disposed evenly to each side of the vertical plane defined by the bicycle. However, other arrangements may also be used.

In some embodiments, a control system is integrated into the rocker plate thereby to provide feedback, which may be used to inhibit tilting in a controlled manner (for example, in response to processing of the velocity signal, thereby to provide feedback representative of centripetal force). This may include a system that selectively increases/decreases pressure in a ball or other bladder, which provides a resilient resistance to tilting of the upper plate relative to the lower plate (a rubberized solution, spring and/or valve may alternately be used to achieve a corresponding result). Such a control system adds significantly to the cost of the overall trainer assembly, but can be used to provide a force feedback mechanism by which simulator logic is able to move the bicycle, adding to a realistic feel. In some embodiments, force feedback, for example, via a servomotor, is integrated into front wheel support unit 151.

Regardless of the style of rocker plate used, a sensor is configured to generate a signal referred to herein as a "tilt signal" 141. The tilt signal 141 is representative of tilt of bicycle 100 relative to a vertical plane. There are various forms of sensor hardware that may be used to generate tilt signal 141, including:

- A digital level senor mounted to any of: the upper plate of rocker plate 150; front wheel support unit 151; trainer 10; or a component of bicycle 100.
- An IMU, gyroscope, or other such component mounted to any of: the upper plate of rocker plate 150; front wheel support unit 151; trainer 10. For example, this may be an IMU mounted in front wheel support unit 151 configured to determine both steering and tilt, allowing a conventional "dumb" rocker plate to be used.
- A smartphone having an IMU mounted to the stem of bicycle 100. This may optionally measure both tilt and steering.
- Pressure sensors configured to monitor pressure in bladders (e.g., inflated balls), which are provided by the rocker plate on either side of the bicycle plane, such that pressure changes depending on bicycle tilt (pressure increased in a right-side bladder progressively as the bicycle is tilted further to the right). A load cell or strain gauge may be used.
- Strain gauges provided by the rocker plate on either side of the bicycle plane.

Tilt signal 141 is transmitted via a wired or wireless coupling to a velocity signal input 162 of a control unit 160. Control unit 160 then passes on the tilt signal, or a signal derived therefrom, to a simulator system 170.

In some embodiments, control unit 160 processes the steering signal and the tilt signal thereby to provide a single combined steering signal to simulator system 170, this combines signal being in the form of a steering or turning input in a format required by the simulator system (for example, representative of an angle of turn or the like). In other embodiments, this combining of steering and tilt is performed in the simulator system.

Accordingly, simulator system 170 provides a system for providing simulation of bicycle activity, the system including:

(i) A velocity input that is configured to receive a signal representative of user interaction with a bicycle drivetrain mechanism. For example, this is in some cases a signal derived directly or indirectly from a sensor component of trainer 10. This may include a signal that is received by velocity signal input 162, and processed into a form compatible with simulator system 170.

(ii) A steering input that is configured to receive a signal representative of user interaction with a bicycle handlebar turn mechanism. For example, this is in some cases a signal derived directly or indirectly from a sensor component of which provides steering signal 142, for example, a sensor in front wheel support unit 151. The steering input may include a signal that is received by steering signal input 161, and processed into a form compatible with simulator system 170.

(iii) A tilting input that is configured to receive a signal representative of user interaction with a bicycle tilt mechanism. For example, this is in some cases a signal derived directly or indirectly from a sensor component of rocker plate 150, or sensor mounted to front wheel support unit 151 or bicycle 100. This may include a steering signal 142 that is received by tilt signal input 163, and processed into a form compatible with simulator system 170.

In some embodiments, the steering and tilting input are combined into a single turning metric by control unit 160, and that single turn metric is provided to simulator system 170 to enable control over turning in the simulation. In such cases, simulator system 170 still provides a steering input and a turning input; these are however combined into a single input, which receives a signal derived from both steering and turning signals.

In the illustrated embodiment, control unit 160 and simulator system 170 are in combination configured to process the signals received from the velocity input, the steering input and the tilting input, thereby to deliver a visual simulation of bicycle riding via a display screen, wherein the visual simulation includes simulated steering based on a combination of at least:

(i) the signal representative of user interaction with the bicycle handlebar turn mechanism; and (ii) the signal representative of user interaction with the bicycle tilt mechanism.

The processing is preferably configured such that the simulation is configured to recognize counter steering, as described in PCT publication WO202122297.

Control unit 160 provides a data collection and transmission hub for a simulator system such as simulator system 170. Often, hardware associated with simulator system 170 is limited in terms of a number of wireless devices that can be connected (for example, when the simulator system uses, for example, APPLE TV®, hardware with simulator software executing as a software application thereon). In such cases, control unit 160 is used to receive multiple wireless signals from multiple wireless devices, and provide them as a single wireless signal to the simulator system. This preferably includes one or more wireless signals from bicycle monitoring sensors (for example, velocity, steering angle, tilt, cadence, etc.) and at least one device that collects physiological data from a wearable physiological sensor (for example, a heart rate monitor). The control unit may in this regard be embedded in trainer 10.

The illustrated example includes a torso-mounted heart rate sensor device 190, which includes one or more motion sensor components (e.g., accelerometer, gyroscope, IMU, etc.). Such heart rate sensors are currently available, for example, a device currently marketed under the brand name "GARMIN® HRM-PRO." Heart rate sensor device 190 provides to control unit 160 a signal representative of human performance data 165, for example time series data representative of heart rate. Display screen 180 additionally provides to control unit 160 a signal representative of body position attributes 164. This may include raw and/or partially processed motion sensor data (which is, for instance, processed by processing module 166 thereby to determine current body position attributes), or may alternately include processed data that is inherently representative of body position. In relation to the latter, in some examples, heart rate sensor device 190 provides data representative of a current state of activity, including data representative of one or more of: standing and pedaling; sitting and pedaling; transitions between standing and pedaling; degree of tuck (angle of torso relative to horizontal); pedaling cadence; torso tilt/lean; and/or other artefacts. It will be appreciated that whether these data artefacts are determined from motion sensor date within heart rate sensor device 190, control unit 160, or via another processing unit is a matter of design choice.

The body position attribute data 164 is used to control configuration of simulation parameters and/or display parameters as described further above. For example, body position may be used to set simulation parameters relevant to a virtual wind resistance, which may include a parameter that controls simulated deceleration, a parameter that sets trainer resistance; and/or a parameter that affects mapping of a trainer velocity signal to a simulated velocity signal. Body position may also be used to control display parameters, such as body position of an animated virtual avatar in a virtual environment rendered on display screen 180.

In further embodiments, body position data is received from a component other than heart rate sensor device 190, for example, via: (i) a smartphone mounted to the upper body of the user; (ii) another motion sensor enabled device mounted to the upper body of the user; (iii) a smart watch having a motion sensor (in which case, standing/seating is inferred from attributes of grip on handlebars); (iv) headwear such as VR/AR equipment, a helmet, or eyewear having in-built motion sensors; (v) processing of data from front wheel support unit 151 and/or rocker plate 150 (noting that attributes of turning and/or tilting may be processed to determine whether a rider is pedaling in a seated position or a standing position, for example, using an AI classifier trained using data from each scenario); and (vi) other hardware.

In further embodiments, additional sensors may be incorporated. One example is braking sensors (for example, sensors coupled to a brake lever or simulated brake lever), by which a user may provide input that the simulator processes to decrease simulated velocity.

Figure 2:
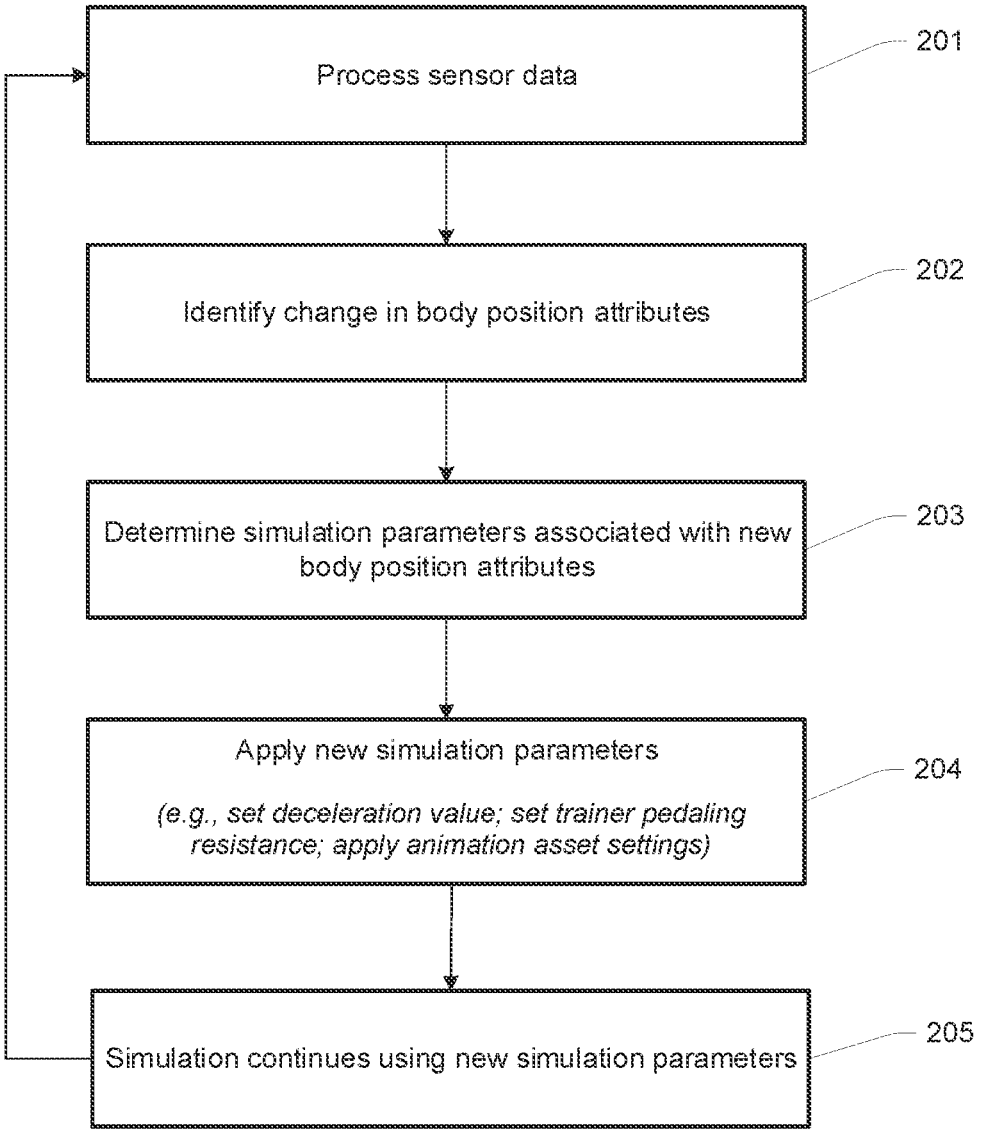
FIG. 2 illustrates a method according to one embodiment.

FIG. 2 illustrates a method according to one embodiment. This method may be performed by a simulation system, or by a simulation system in combination with one or more connected comments.

Block 201 represents processing of sensor data, for example, motion sensor data. This may include motion sensor data collected from sensors mounted to a user (e.g., torso, wrist or head mounted, preferably provided via a wearable smart device, which may serve additional purposes), sensors mounted to a bicycle that is used with a trainer system, and/or sensors provided by a component of a trainer system (for example, a wheel block, rocker plate, or the like).

Block 202 represents a process including identifying a change in body position attributes. This may include determining from motion sensor data that there has been a change in state from a first set of body position attributes to a second set of body position attributes (e.g., seated to standing, lean to side, twist to side, or others).

Block 203 represents determining simulation parameters associated with new body position attributes. This may include any one or more of: a simulation parameter associated with simulated deceleration; a simulation parameter associated with trainer resistance; a simulation parameter associated with display avatar animation; or other parameters.

Block 204 represents a process including applying the new simulation parameters. For example, this may include adjusting a virtual deceleration value, adjusting a degree of physical resistance being applied by the trainer system, controlling rendering of a display to use particular animation assets, and so on. The simulation then continues with the new simulation parameters as represented by block 205, and sensor data continues to be processed as represented by block 201.

It will be appreciated that the above disclosure provides technology by which bicycle trainer-based simulations are able to be improved, thereby to provide added realism, a more "natural" feel, and an overall improved user experience.

It should further be appreciated that in the above description of exemplary embodiments of the disclosure, various features of the disclosure are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed disclosure requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some, but not other features included in other embodiments, combinations of features of different embodiments are meant to be within the scope of the disclosure, and form different embodiments, as would be understood by those skilled in the art. For example, in the following claims, any of the claimed embodiments can be used in any combination.

In the description provided herein, numerous specific details are set forth. However, it is understood that embodiments of the disclosure may be practiced without these specific details. In other instances, well-known methods, structures and techniques have not been shown in detail in order not to obscure an understanding of this description.

Thus, while there has been described what are believed to be the preferred embodiments of the disclosure, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present disclosure.

What is claimed is:

1. A method for controlling a simulation system, wherein the simulation system includes:

an input configured to receive data representative of user pedaling interaction with a bicycle training system;

one or more further inputs which receive data collected by further sensors;

a processing module configured to process the data received via the input and the one or more further inputs thereby to define simulation parameters, including: (i) performance parameters for simulated bicycle riding; and (ii) display parameters for a graphical interface which is configured to cause rendering of visual simulation data for the simulated bicycle riding;

the method including:

(i) identifying, in the data collected by the further sensors, data derived from a body-worn motion sensor device;

(ii) processing the data derived from the body-worn motion sensor device thereby to define data representative of body position attributes; and (iii) operating the processing module to set one or more of the simulation parameters in response to the data representative of the body position attributes;

wherein the step of operating the processing module to set the one or more of the simulation parameters in response to the data representative of the body position attributes includes: setting a wind resistance parameter responsive to the body position attributes.

2. The method of claim 1, wherein setting the wind resistance parameter responsive to the body position attributes includes identifying whether the body position attributes are representative of a standing pedaling motion or a seated pedaling motion.

3. The method of claim 1, wherein setting the wind resistance parameter responsive to the body position attributes includes identifying the body position attributes representative of a transition between a seated position and a standing position, thereby to determine a current pedaling state of seated or standing.

4. The method of claim 1, wherein setting the wind resistance parameter responsive to the body position attributes includes identifying via the body position attributes a torso position.

5. The method of claim 1, wherein setting the wind resistance parameter responsive to the body position attributes includes:

(i) identifying whether the body position attributes are representative of a standing pedaling motion or a seated pedaling motion; and (ii) identifying via the body position attributes a torso position.

6. The method of claim 1, wherein in response to setting a wind resistance parameter responsive to the body position attributes, a control signal is defined to cause adjustment of a pedaling resistance setting in the bicycle training system.

7. The method of claim 1, wherein the step of operating the processing module to set the one or more of the simulation parameters in response to the data representative of the body position attributes includes: configuring a visual simulation body position parameter on those body position attributes, such that the wind resistance parameter and the visual simulation body position parameter are each representative of whether a user is in a standing position or a seated position.

8. The method of claim 1, wherein the step of operating the processing module to set the one or more of the simulation parameters in response to the data representative of the body position attributes includes:

(i) determining body position attributes representative of sideways lean of a user; and (ii) setting one or more of the simulation parameters in response to the body position attributes representative of the sideways lean of the user.

9. The method of claim 8, wherein setting the one or more of the simulation parameters in response to the body position attributes representative of the sideways lean of the user includes configuring a visual simulation body position parameter to display corresponding sideways lean for a virtual avatar.

10. The method of claim 9, wherein the simulation system collects data representative of bicycle tilt, and wherein configuring the visual simulation body position parameter to display the corresponding sideways lean for the virtual avatar is additionally responsive to the data representative of the bicycle tilt.

11. The method of claim 8, wherein setting the one or more of the simulation parameters in response to the body position attributes representative of the sideways lean of the user includes configuring a virtual steering parameter based on the sideways lean of the user.

12. The method of claim 11, wherein the simulation system collects data representative of the bicycle tilt, and wherein configuring the virtual steering parameter is additionally responsive to the data representative of the bicycle tilt.

13. The method of claim 1, wherein the step of operating the processing module to set the one or more of the simulation parameters in response to the data representative of the body position attributes includes: defining display parameters for a graphical interface based on identified torso rotation of the user.

14. The method of claim 13, wherein defining display parameters for the graphical interface based on the identified torso rotation of the user controls direction in a virtual environment of a first person view, thereby to enable simulated sideways view directional control.

15. The method of claim 1, wherein operating the processing module to set the one or more of the simulation parameters in response to the data representative of the body position attributes includes providing a control signal to the bicycle training system thereby to control one or more parameters of the bicycle training system.

16. The method of claim 1, wherein the body-worn motion sensor device is provided via a torso-worn device.

17. The method of claim 16, wherein the torso-worn device includes a body function monitor.

* * * * *